US006701659B1

(12) United States Patent
Langner

(10) Patent No.: US 6,701,659 B1
(45) Date of Patent: Mar. 9, 2004

(54) CARTRIDGE CONTAINMENT DEVICE AND METHOD

(76) Inventor: F. Richard Langner, 16610 Laser Dr. #5, Ftn. Hills, AZ (US) 85268

( * ) Notice: Subject to any disclaimer, the term of this patent is extended or adjusted under 35 U.S.C. 154(b) by 0 days.

(21) Appl. No.: 10/358,882

(22) Filed: Feb. 4, 2003

(51) Int. Cl.[7] ..... F41A 15/00
(52) U.S. Cl. ..... 42/98
(58) Field of Search ..... 42/98; 224/931; 89/33.4

(56) References Cited

U.S. PATENT DOCUMENTS 1,180,439 A * 4/1916 RudLoff ..... 89/195
3,881,268 A * 5/1975 Peterson ..... 42/98
3,893,253 A * 7/1975 Weatherby et al. ..... 42/98
3,984,932 A * 10/1976 Morton ..... 42/98
4,384,421 A * 5/1983 Rodgers ..... 42/98
4,621,444 A * 11/1986 Anderson ..... 42/98

* cited by examiner

*Primary Examiner*—Michael J. Carone
*Assistant Examiner*—D Buckley
(74) *Attorney, Agent, or Firm*—LaValle D. Ptak

(57) ABSTRACT

A cartridge containment device and method is designed to contain or catch unfired cartridges ejected from an automatic or semi-automatic firearm during unloading. To accomplish this, a cartridge containment box having an open top and otherwise configured with the general external configuration of a standard cartridge magazine is inserted into the firearm in place of the cartridge magazine. A blocking plate is attached to the cartridge containment box; and when the box is inserted into the firearm, the blocking plate is located adjacent the ejection port of the firearm, and prevents cartridges from being expelled therefrom. The cartridges then drop into the containment box for removal from the firearm.

9 Claims, 4 Drawing Sheets

CARTRIDGE CONTAINMENT DEVICE AND METHOD

BACKGROUND

This invention relates to a device and method for containing an unfired cartridge when it is ejected from an automatic or semi-automatic firearm. The conventional process of unloading a semi-automatic or fully automatic firearm generally follows the steps of first pointing the firearm in a safe direction, or into a clearing device. The cartridge magazine then is removed from the firearm. Next, the bolt is pulled back to eject the unfired cartridge from the chamber.

Presently, the unfired cartridge is ejected from the firearm onto the floor or ground, resulting in the possibility of damage to the cartridge or contamination of the cartridge. There also is a possibility of the cartridge being detonated by an object (such as a small sharp stone) when the cartridge hits the ground.

After the cartridge is ejected, the bolt closes automatically when released by the operator. Typically, the person clearing or unloading the firearm then reopens the bolt and holds it open to ensure that the firearm is indeed clear by means of a visual inspection. The operator then releases the bolt once again; and the firearm is closed.

In normal operation of automatic or semi-automatic firearms, a spring loaded catch in the magazine presses against a bolt retaining latch in the firearm to hold the bolt open after the last round has been fired. This allows for immediate reloading by insertion of a new magazine without requiring the operator to cycle the bolt to chamber another round. When a partially full magazine is removed from a firearm, however, the bolt retaining latch is not engaged; so that the ejection of the round in the firing chamber from the firearm normally results in an automatic reclosing of the bolt, as described above.

It is desirable to provide a cartridge containment device and method for capturing and containing an unfired cartridge from the firing chamber of a firearm when the firearm is unloaded.

SUMMARY OF THE INVENTION

It is an object of this invention to provide a cartridge containment device and method.

It is another object of this invention to provide cartridge containment device and method for capturing and containing an unfired cartridge from an automatic or semi-automatic firearm during unloading of the firearm.

It is an additional object of this invention to provide an improved cartridge containment device which replaces the cartridge magazine of a semi-automatic or automatic firearm to capture an unfired cartridge from the firing chamber during the unloading process.

It is a further object of this invention to provide an improved catching and containment device for an unfired cartridge during the unloading of an automatic or semi-automatic firearm which prevents ejection of the cartridge from the firearm and places the unfired cartridge in the containment device.

In accordance with a preferred embodiment of the invention, a device for catching and containing a cartridge during the unloading of a pump-action, automatic or semi-automatic magazine-fed firearm having an ejection port (with or without an ejection port cover) includes a cartridge containment box. The containment box has an open top and is enclosed on all of its other sides. It is configured, at least in the top portion thereof, to the general configuration of a cartridge magazine used with the particular firearm with which it is to be used. The open top underlies the loading/ejection chamber of the firearm. A plate is spaced from and attached to the cartridge containment box, and extends upwardly to overlie the ejection port of the firearm to prevent a cartridge from being ejected therefrom and to cause the cartridge to fall into the containment box.

DETAILED DESCRIPTION

Figure 1:
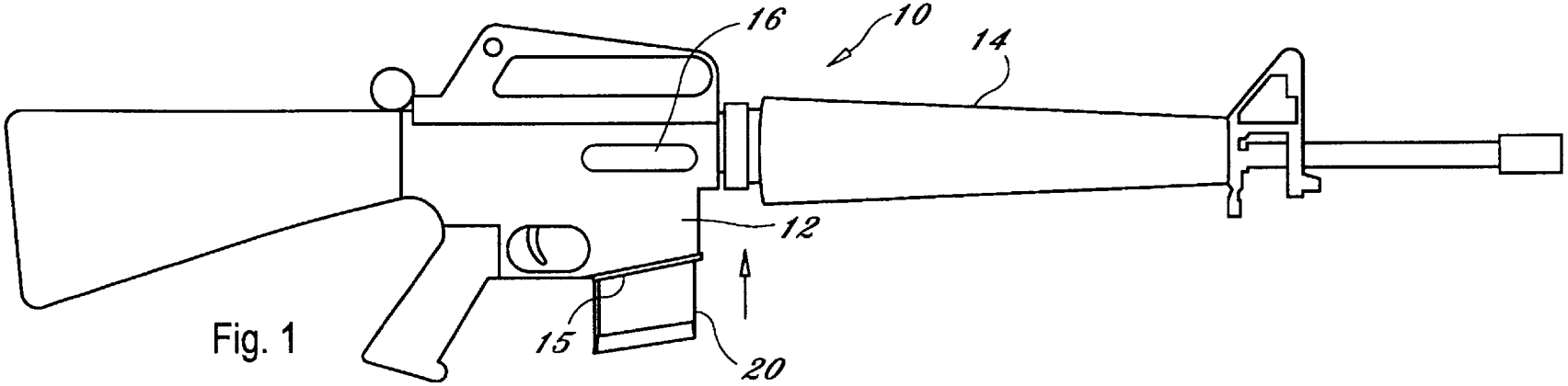
FIG. 1 is a side view of a semi-automatic firearm of the type with which a preferred embodiment of the invention is used showing the manner of insertion of a cartridge magazine.
Figure 2:
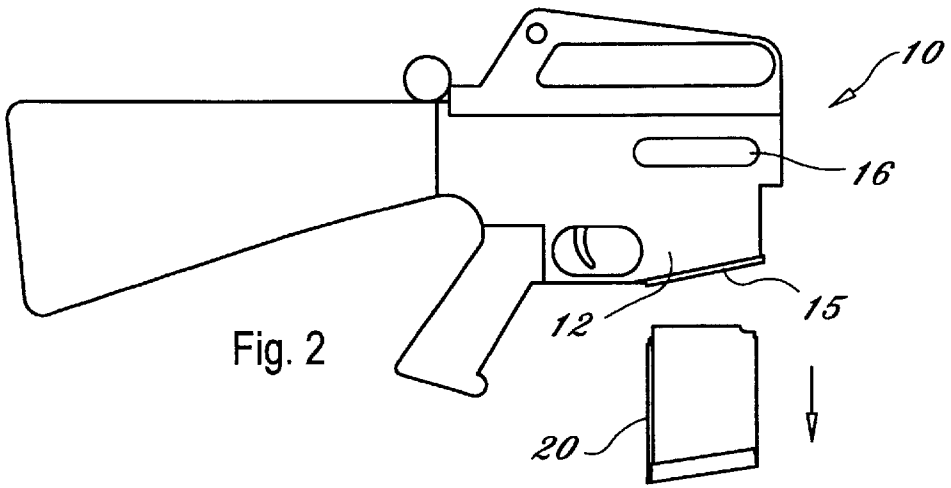
FIG. 2 is a partial side view of the firearm of FIG. 1 showing the removal of a cartridge magazine.

Reference now should be made to the drawings in which the same or similar reference numbers are used throughout the different figures to designate the same components. FIGS. 1 and 2 illustrate a conventional automatic or semi-automatic firearm 10, which (by way of example) may be an AR-15 or M-16 firearm. Such a firearm 10 includes a barrel portion 14 and a magazine receiving portion 12 for insertion of a cartridge magazine 20 through a cartridge receiving opening 15 in the bottom of the firearm just forward of the trigger housing. The loading/ejection chamber of the firearm is located immediately above the top of a cartridge magazine 20 when it is fully inserted into the firearm 10 as shown in FIG. 1. An ejection port 16 also is located in alignment with the top of the standard cartridge magazine 20 when it is inserted into the firearm.

As illustrated in FIG. 2, the cartridge magazine 20 may be removed completely from the firearm by releasing it and pulling it downwardly out of the cartridge receiving port 15. If the cartridge magazine 20 is removed from the firearm, as illustrated in FIG. 2, prior to the firing of the last cartridge in the magazine 20, there will remain a cartridge in the firing chamber of the firearm, even though the magazine 20 has been removed.

Figure 3A:
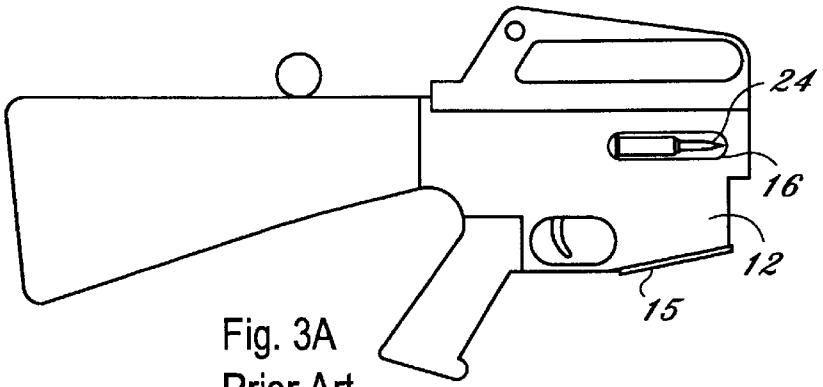
Fig. 3A Prior Art
FIGS. 3A and 3B illustrate features of operation of a standard firearm of the type shown in FIG. 1.
Figure 3B:
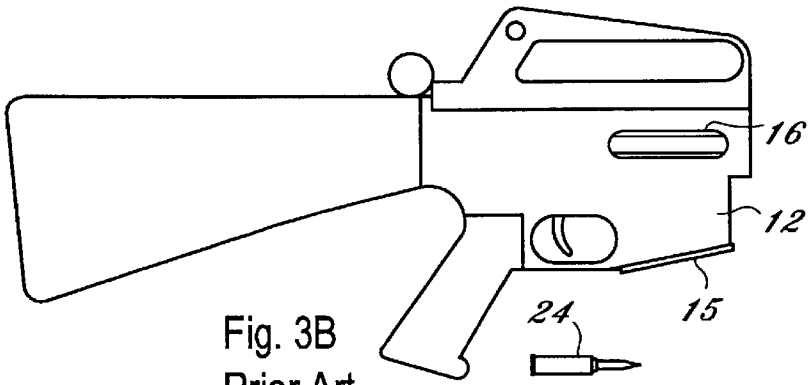
Fig. 3B Prior Art

As mentioned above, the cartridge magazine 20 first is removed, as shown in FIG. 2, prior to unloading the firearm. Then, the bolt is pulled back to eject an unfired cartridge 24 shown in FIG. 3A from the firing chamber through the ejection port 16 located in the side of the firearm just above the trigger housing. FIG. 3A illustrates the position of the unfired cartridge 16 at the time the bolt is pulled back and the ejection port 16 is opened. In the standard unloading of such a firearm, the cartridge 24 then is ejected through the ejection port 16 onto the floor or ground, as illustrated in FIG. 3B. As mentioned above, this is an undesirable event, but one which has been tolerated as necessary in the past.

Figure 4A:
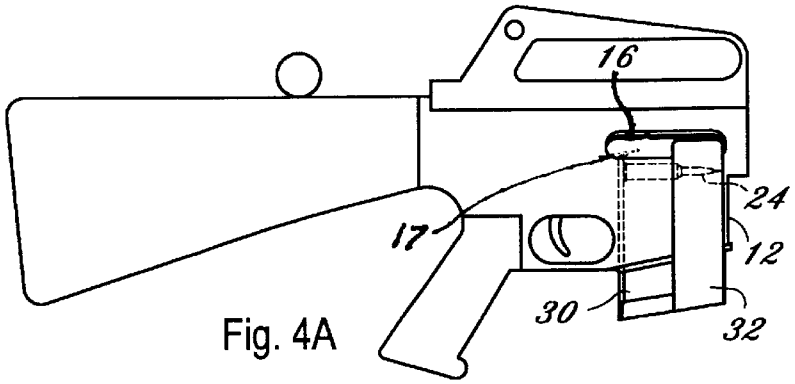
FIGS. 4A and 4B illustrate the use of a preferred embodiment of the invention with the firearm of FIG. 1.
Figure 4B:
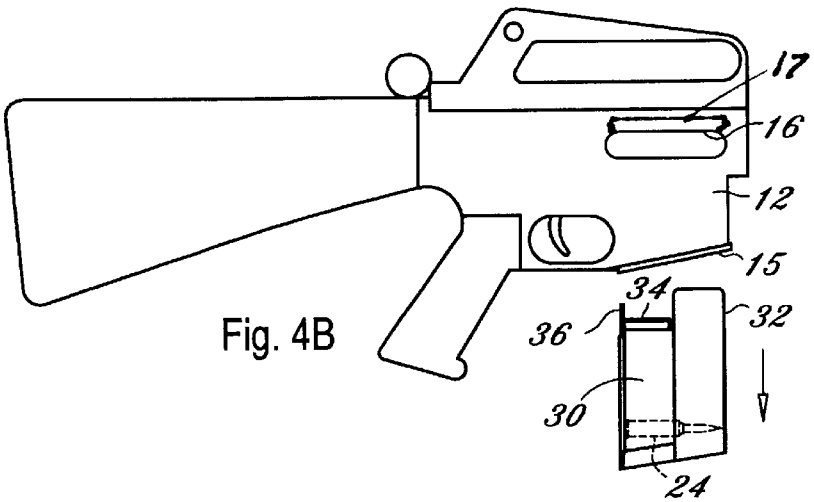
Figure 6:
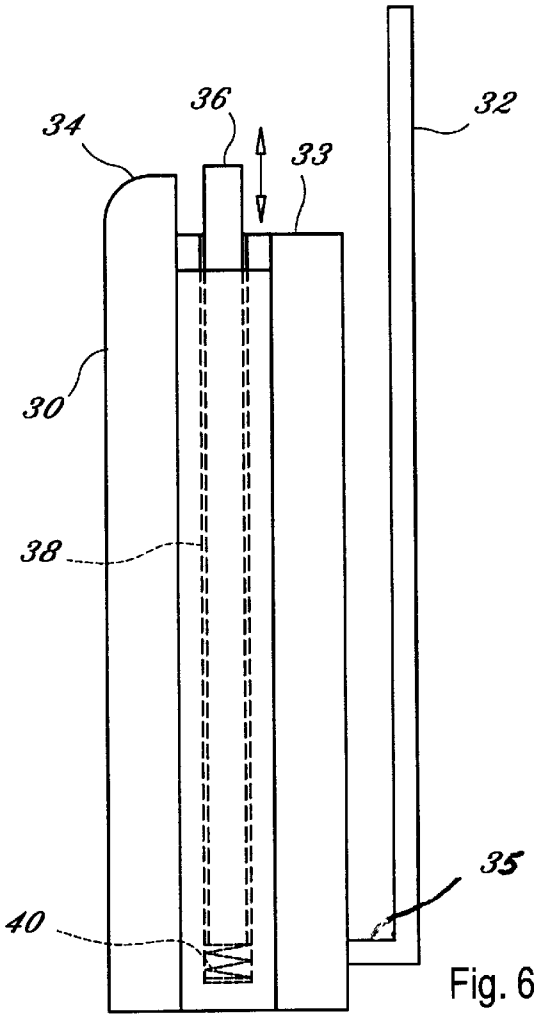
FIG. 6 is an end view of the embodiment shown in FIG. 5.
Figure 5:
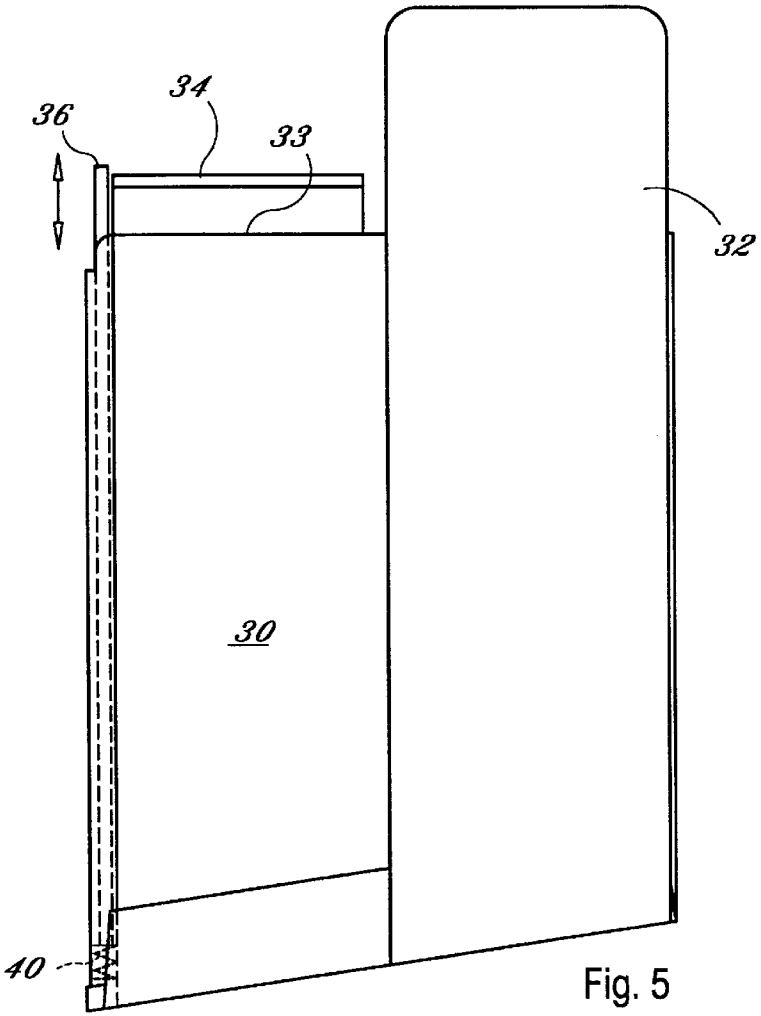
FIG. 5 is a side view of a preferred embodiment of the invention.
Figure 8:
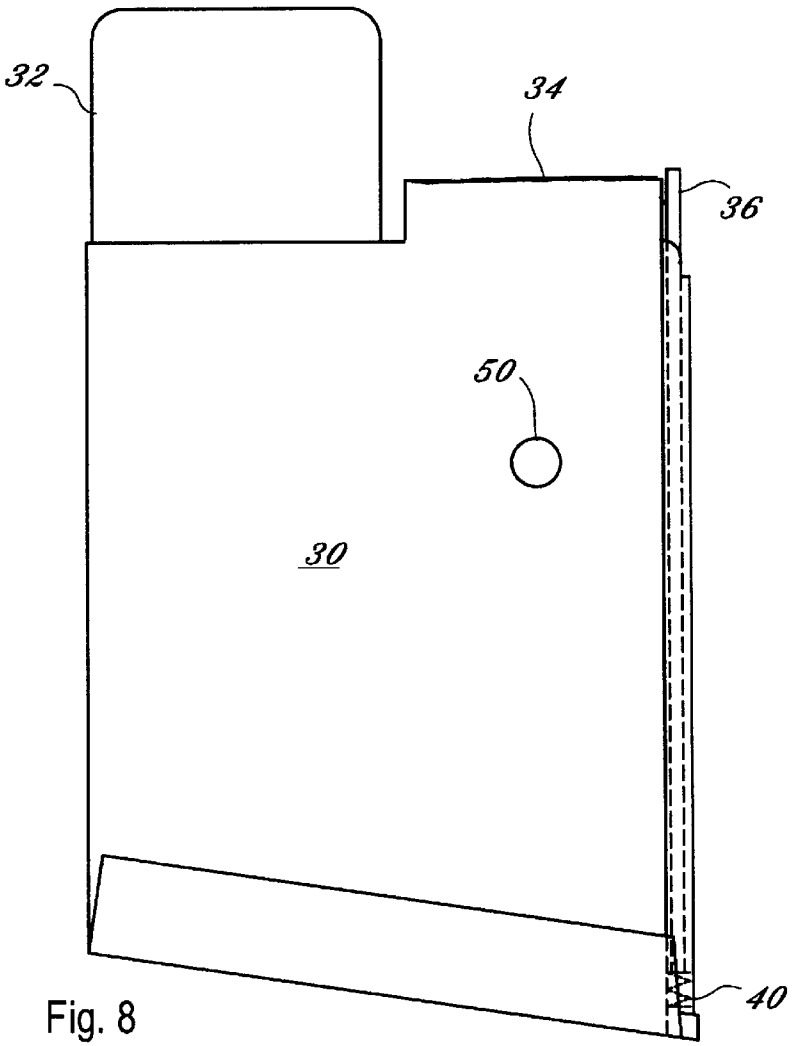
FIG. 8 is an opposite side view of the embodiment shown in FIG. 5.

In order to prevent the uncontrolled ejection of the cartridge 24 when the firearm is being unloaded for storage and carrying, the cartridge containment device which is illustrated in detail in FIGS. 5, 6 and 8, and which is diagrammatically shown in FIGS. 4A and 4B, has been devised. Basically, the cartridge containment device 30 has the same general configuration as the standard cartridge magazine 20 used with the firearm.

The external dimensions of the containment device 30 are configured to conform with those of a standard cartridge magazine; so that the containment device 30 fits into the firearm cartridge receiving region 12 in exactly the same manner as a standard cartridge magazine 20. The containment device 30, however, unlike a cartridge magazine, basically comprises an empty box which replaces the magazine 20. The containment box does not contain the internal spring platform of a standard magazine 20 which is used to press cartridges in the magazine 20 upwardly into position for insertion into the firing chamber of the firearm. The box basically is an empty box.

In addition, the containment device 30 includes a substantially rectangular flat plate 32, which is spaced from the side of the cartridge containment device on the same side of the firearm as the ejection port 16. The plate 32 is parallel to the box of the cartridge containment device 30; so that when the containment device 30 is inserted into the firearm in the same manner as a cartridge magazine, the plate 32 overlies the outside of the firearm. The upper portion extends over the ejection port 16, as illustrated in FIG. 4A. This position also prevents the ejection port cover 17 from fully opening. The space between the outside surface of the box of the containment device 30 and the inner surface of the plate 32 is provided by an extension or leg 35, which attaches the plate 32 to the bottom of the containment box, as illustrated most clearly in FIG. 6.

As shown in FIG. 8, the top of the cartridge containment device 30 located toward the rear of the firearm includes a curved or angled leading edge 34. This edge pushes open the magazine catch (not shown) of the firearm to allow the containment device 30 to be easily inserted into the firearm until the catch (not shown) of the firearm enters a retaining hole 50 on the left-hand side of the cartridge containment device (FIG. 6) and as clearly shown on the side illustrated in FIG. 8. The function of this process is identical to the insertion of an actual cartridge magazine 20 into the firearm; and the external dimensions of the surface 34 and the location of the retaining hole 50 are substantially duplicates of similar components of a standard cartridge magazine 20.

At the rear of the cartridge containment device 30, there is a spring actuated plunger 36 which is carried in a channel 38 formed in the rear end wall of the cartridge containment device 30. A compression spring 40 is located at the lower end of the plunger 36 to push the plunger up and against the bolt retaining latch (not shown) of the firearm 10. When the bolt of the firearm 10 is opened and pulled back beyond the latch, the plunger 36 is pressed upwardly by the spring 40 to push the latch into the return path of the spring loaded bolt of the firearm. This causes the bolt to be held open by pushing against the latch, and the plunger 36 is no longer required. Thus, the cartridge containment device 30 may be removed from the firearm in the same manner as a standard cartridge magazine 20 is removed. This then allows visual inspection of the firearm through the open ejection port 16 (FIG. 4B) to ensure that the firing chamber has been cleared of any live cartridge.

As noted above, some semi-automatic and automatic firearms, such as the AR-15 and M-16, have the spring loaded cover 17 over the ejection port 16 which protects the bolt and receiver area of the firearm from contamination. The cover 17 snaps open when the bolt is opened (pulled rearward), to allow the ejected cartridge 24 to clear the firearm. When the cartridge containment 30 is positioned as shown in FIG. 4A, the plate 32, which extends upwardly over the ejection port 16, prevents the cover 17 of such firearms from fully opening, which further blocks the cartridge 24 from exiting the firearm. As a consequence, the cartridge 24 falls into the bottom of the containment device, as shown in FIG. 4B, allowing its controlled removal from the firearm for subsequent reloading into a new standard cartridge magazine 20, or for other storage as desired.

Figure 7:
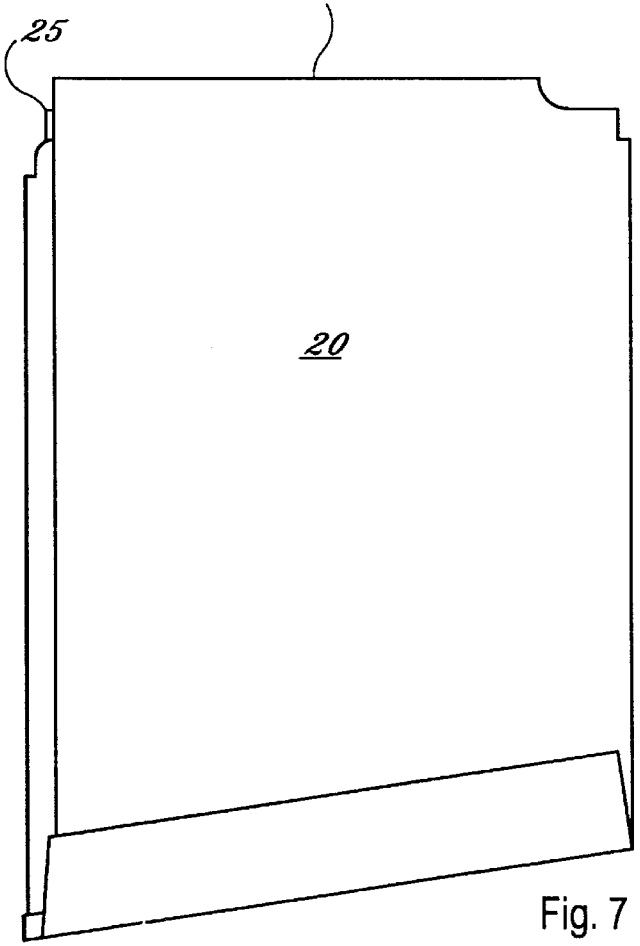
FIG. 7 is a side view of a standard prior art cartridge magazine.

FIG. 7 illustrates the same orientation of a standard cartridge magazine 20 as shown for the orientation of the cartridge containment device 30 illustrated in FIG. 5. The standard magazine has an upper front edge 23 which is typically higher than the top edge 33 of the front side of the cartridge containment device, as shown in FIGS. 5 and 6. Typically, the edge 23 is at the same height as the upper portion of the curved or angled edge 34 shown in the device of FIGS. 5 and 6. For a standard cartridge magazine 20, this is done to facilitate and align the cartridges into the firing chamber for contact by the bolt as it moves forward over the top of the magazine 20. When the last cartridge of a magazine, such as the magazine 20, has been inserted into the firing chamber of the firearm and the bolt once again returns, a tab 25 on the top of the spring loaded platform in the magazine 20 pushes up against the bolt retaining latch to hold the bolt open. Thus, when an empty magazine 20 is removed, the bolt is in its rearmost or open position, facilitating the insertion of a new, fully loaded cartridge without requiring an extra step of pulling the bolt back. It is this same action which is effected by the spring actuated plunger 36 of the device 30 to allow the cartridge containment device 30 to be removed from the firearm, leaving the ejection port open and the bolt back for the visual inspection discussed above. No modification to the firearm 10 itself is necessary to utilize the preferred embodiment of the invention described above. Nothing whatsoever needs to be done in any way to change the firearm to accommodate the cartridge containment device 30 which has been described and shown.

The preferred embodiment of the invention which has been described above and which is shown in the drawings, is to be considered as illustrative and not as limiting. The containment device 30 may be constructed of metal, molded plastic or other composite materials to suit the particular operating environment in which the device is to be used. Various other changes and modifications will occur to those skilled in the art for performing substantially the same function, in substantially the same way, to achieve substantially the same result without departing from the true scope of the invention as defined in the appended claims.

What is claimed is:

1. A device for catching and containing a cartridge during unloading of a magazine fed firearm having an ejection port for spent and unfired cartridges including in combination:

a cartridge containment box having an open top and configured to be inserted into a firearm in place of a cartridge magazine, the open top underlying the loading/ejection chamber of the firearm; and means spaced from and attached to the cartridge containment box for preventing a cartridge from being ejected from the ejection port of the firearm whereupon the cartridge falls into the cartridge containment box.

2. A device according to claim 1 wherein the means for preventing cartridges from being ejected from the ejection port comprises a plate spaced from and attached to the cartridge containment box and extending upwardly therefrom to a position adjacent the ejection port of the firearm.

3. A device according to claim 1 wherein the means for preventing cartridges from being ejected from the ejection port comprises a substantially rectangular flat plate having a top edge and a bottom edge, with the bottom edge thereof connected to the cartridge containment box and spaced a predetermined distance therefrom to overlie the ejection port of a firearm when the cartridge containment box is inserted into the firearm.

4. A device according to claim 3 wherein the cartridge containment box further includes a spring-actuated plunger located to press against a bolt retaining latch of the firearm.

5. A device according to claim 1 wherein the cartridge containment box further includes a spring-actuated plunger located to press against a bolt retaining latch of the firearm.

6. A method for catching and containing cartridges during unloading of a magazine-fed firearm having an ejection port for spent and unfired cartridges including the steps of:

placing a cartridge containment box in the position of a cartridge magazine of a firearm with the cartridge containment box having an open top underlying the loading/ejection chamber of the firearm;

preventing cartridges from being ejected through the ejection port; and causing cartridges to drop into the cartridge containment box.

7. A method according to claim 6 wherein the step of blocking cartridges from being ejected through the ejection port of the firearm includes placing a blocking plate adjacent the ejection port opening.

8. The method according to claim 7 wherein the step of placing the blocking plate adjacent the ejection port is effected simultaneously with the step of placement of the cartridge containment box in the firearm.

9. A method for catching and containing cartridges during unloading of a magazine-fed firearm having an ejection port for spent and unfired cartridges including the steps of:

placing a cartridge containment box in the position of a cartridge magazine of a firearm with the cartridge containment box having an open top underlying the loading/ejection chamber of the firearm;

preventing cartridges from being ejected through the ejection port by preventing the ejection port cover from fully opening; and causing cartridges to drop into the cartridge containment box.

* * * * *